US007282014B2

(12) United States Patent
Krietzman

(10) Patent No.: US 7,282,014 B2
(45) Date of Patent: Oct. 16, 2007

(54) DUAL CIRCLING EXERCISE METHOD AND DEVICE

(76) Inventor: Mark Howard Krietzman, P.O. Box 3185, Palos Verdes, CA (US) 90274

( * ) Notice: Subject to any disclaimer, the term of this patent is extended or adjusted under 35 U.S.C. 154(b) by 129 days.

(21) Appl. No.: 10/923,220

(22) Filed: Aug. 20, 2004

(65) Prior Publication Data

US 2005/0043153 A1 Feb. 24, 2005

Related U.S. Application Data

(60) Provisional application No. 60/497,283, filed on Aug. 22, 2003.

(51) Int. Cl.

| | |
|---|---|
| ***A63B 22/12*** | (2006.01) |
| ***A63B 69/16*** | (2006.01) |
| ***A63B 21/00*** | (2006.01) |
| ***A63B 21/012*** | (2006.01) |
| ***A63B 21/015*** | (2006.01) |

(52) U.S. Cl. ..... 482/92; 482/62; 482/114; 482/118; 482/119

(58) Field of Classification Search ..... 482/92, 482/57, 62, 80, 905

See application file for complete search history.

(56) References Cited

U.S. PATENT DOCUMENTS

| | | | | |
|---|---|---|---|---|
| 2,921,791 | A | 1/1960 | Berne | |
| 3,516,661 | A | 6/1970 | Hansen | |
| 3,662,602 | A | 5/1972 | Weiss | |
| 3,713,653 | A | 1/1973 | Romans | |
| 3,721,438 | A | 3/1973 | Kusmer | |
| 4,060,241 | A | 11/1977 | Hegel | |
| 4,249,727 | A | 2/1981 | Dehn | |
| 4,517,966 | A | 5/1985 | Von Othegraven | |
| 4,611,807 | A | 9/1986 | Castillo | |
| 4,717,145 | A | 1/1988 | Chininis | |
| 4,746,806 | A * | 5/1988 | Campagnuolo et al. | 290/1 R |
| 4,842,272 | A | 6/1989 | Jennings | |
| 4,900,014 | A | 2/1990 | DeGraff | |
| 5,037,088 | A | 8/1991 | Berstein | |
| 5,094,446 | A | 3/1992 | Wiedner | |
| 5,135,449 | A * | 8/1992 | Jones | 482/72 |
| 5,158,519 | A * | 10/1992 | Hughes | 482/118 |
| 5,282,748 | A | 2/1994 | Little | |
| 5,324,242 | A * | 6/1994 | Lo | 482/63 |
| 5,330,402 | A * | 7/1994 | Johnson | 482/62 |
| 5,580,338 | A * | 12/1996 | Scelta et al. | 482/62 |
| 5,803,876 | A | 9/1998 | Hickman | |
| 5,868,650 | A * | 2/1999 | Wu | 482/62 |
| 5,913,755 | A | 6/1999 | Chung | |
| 5,964,685 | A * | 10/1999 | Boland | 482/122 |
| 6,030,323 | A * | 2/2000 | Fontenot et al. | 482/111 |
| 6,056,676 | A * | 5/2000 | Adams | 482/112 |
| 6,120,416 | A * | 9/2000 | Walker | 482/57 |
| 6,296,598 | B1 * | 10/2001 | Boland | 482/126 |
| 6,328,677 | B1 | 12/2001 | Drapeau | |
| 6,379,289 | B1 | 4/2002 | Gossie | |

(Continued)

*Primary Examiner*—Stephen R. Crow
*Assistant Examiner*—Arun Chhabra
(74) *Attorney, Agent, or Firm*—John R. Wahl; Greenberg Traurig, LLP

(57) ABSTRACT

An exercise device which uses two generally opposing grips on guides to guide a user through circular movements for exercise of the human body. The grips may be movably mounted to side supports or a central base. Resistance to the user's movement of the grips may be added.

14 Claims, 10 Drawing Sheets

U.S. PATENT DOCUMENTS 6,626,808 B1 * 9/2003 Adams ..... 482/140
6,666,801 B1 * 12/2003 Michalow ..... 482/137
6,837,831 B2 * 1/2005 Lee ..... 482/60
6,964,636 B2 * 11/2005 Verheem et al. ..... 482/121

* cited by examiner

DUAL CIRCLING EXERCISE METHOD AND DEVICE

RELATED APPLICATIONS

This application claims the benefit under 35 U.S.C. Section.119(e) of provisional Application Ser. No. 60/497,283, entitled "Dual Circling Exercise Device," filed Aug. 22, 2003 of which application is incorporated by reference herein.

BACKGROUND OF THE INVENTION

1. Field of the Invention

This present invention relates to an exercise method and an exercise device. More specifically, to an exercise device and method using guided upper body circular motion.

2. Related Art

A variety of resistance exercise devices are known in the art. Upper body exercise devices generally involve a linear, or near linear stroke-type movement back and forth, or up and down to simulate weight lifting. The motion on these devices is substantially a back and forth or modified back and forth (up and down) linear motion. Circular motion running or stepping exercise device to simulate running or walking with connected pedals or treadles which move together are known.

Back and forth linear motion exercise devices often require the user to start and stop at the end of each stroke-type movement. Hand pedaling connected bicycle-type hand pedals on connected sprockets are known for physical rehabilitation. It would therefore be a desideratum to have a non-linear motion exercise for the upper body with reduced stops and starts.

SUMMARY OF THE INVENTION

The present invention is a circular motion exercise device. In Tai Chi circular movement is used to build, utilize and develop the "Chi" of the practioneer. When using the circular motion exercise device and method the user's guided arm movement exercise muscles in the human body. The circular movements tend to be non-jarring. The user is positioned adjacent to two grips, such as handles. The grips are each attached to a guide. A guide forms a movable member. Each movable member is pivotally attached to a support or base, whereby the grip has a limited route it can travel when the guide is rotated around the pivot of the support or base.

The guides provide for grip movement in front of the user and to the sides of the user's torso. This grip movement encourages the movement of the user's arms, torso and shoulders. Such movement when extending towards a users torso sides also encourage use of the user's abdominal muscles. A pivot affixes the movable member to a base or support. The Pivots are a movable support for the movable member.

In some exemplary implementations the supports are generally placed opposing each other. The opposing relationship need not be parallel and may be variable, fixed or adjustable. In some embodiments the supports or bases may extend from the ground, rest beneath a user, and/or rest on a user's lap.

In some exemplary implementations the base is generally placed central to the user's torso situated in front of the user's abdomen and the guides can travel a path from the front of a user to the sides of a user's torso.

During exercise, each of a user's hands holds a hand grip. The movement of the grip around a pivot, guided through a generally circular or elliptical movement, also may cause the user's body to move up and down, side to side or both up and down and side to side. A guide associated with each grip provides for the guided movement of the grip. The guide may be a wheel, arm, lever or other movable member. The path of the grip is guided in a generally circling path during exercise. Each of the grips can be moved or "driven" around the pivot on the guide in a clockwise and/or counter clockwise direction.

Resistance against which a user can exercise may be added to increase the work a user must do to push the grips and guides around the pivots. The work a user exerts can be expressed in terms of force. In general terms when the resistance to movement of the pivot is increased the force a user must apply to move the movable members on pivots also increases. The increase in the force the user must apply to move the movable member against resistance can help build a user's strength. The application of force also requires work which in turn may help a user burn Calories.

The resistance against which a user works may be friction based or frictionless. Weight, air, wheels, and magnets are some (but not an exclusive list) of resistance providing elements which may provide a frictionless resistance against which a user can exercise. Gears, belts, wheels, clutches, brakes, weight are some, but not an exclusive list of resistance elements which can use friction to provide resistance against which a user can exercise. Resistance may be provided by a combination of friction and frictionless elements. Resistance may be fixed, variable or adjustable.

In some exemplary implementations the exercise device may provide a guided non-resistance arm and body movement.

In some exemplary implementations the may provide a guided weighted arm and body movement.

In some exemplary implementations the exercise device may provide a guided resistance arm and body movement.

Guided resistance may be provided by a movable wheel, moving members, levers, and weighted members having a frictional or non-friction force applied thereto.

The method of exercise is causing each arm of the user to be guided through a smooth motion, at least partially, around a pivot. The movement for each arm may be a full 360 degree ovid, ellipse or circle around a pivot, or around an arc (which represent a movement of less than 360 degrees around a pivot).

The guided movement of the user's arms maybe together or staggered. The arms may both be moved clockwise around the pivots. The user's arms may be moved counter-clockwise around the pivots. The user may move one arm clockwise around one pivot and one arm counter clockwise around the other pivot.

Leg position may also be used to target a particular muscle group or body region during the method of exercise and the method of use of the device. Feet close in to a seat as opposed to legs outstretched. Feet apart as opposed to feet together. One foot outstretched and one foot close in. The device may be used from a kneeling position, seating, lying down or standing.

Other features and advantages of the present invention will be set forth, in part, in the descriptions which follow and the accompanying drawings, wherein preferred embodiments and some exemplary implementations of the present invention are described and shown, and in part, will become apparent to those skilled in the art upon examination of the following detailed description taken in conjunction with the accompanying drawings or may be learned by practice of the present invention. The advantages of the present invention may be realized and attained by means of the instrumentalities and combinations of elements and instrumentalities particularly pointed out in the appended claims.

BRIEF DESCRIPTION OF THE DRAWINGS

FIG. 1E is a top view of the dual circling exercise device of FIG. 1A.

Figure 1A:
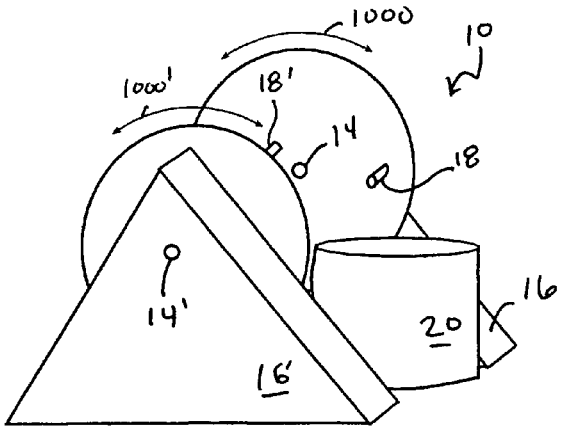
FIG. 1A is a perspective view of a dual circling exercise device.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DESCRIPTION OF PREFERRED EMBODIMENTS OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Shown in FIGS. 1A-1E is a dual circling exercise device 10. A pair of guides shown as rotatable wheel elements 12 & 12' are affixed, generally opposite one another, each to a spindle support 14 & 14'. The spindle support is a pivot around which the movable member (rotatable wheel elements) each move.

The wheel elements need not be parallel. Each rotatable wheel element 12 & 12' is pivotally fixed to a support. In the implantation shown in FIGS. 1A-1E the support is a side base 16 & 16'. Each rotatable wheel element 12 & 12' may also be weighted. The weighting may be evenly distributed around the wheel or distributed unevenly.

A hand grip 18 & 18' is affixed to each rotatable wheel element 12 & 12'. During use each hand grip is held by a user 100 in the user's hands 102.

To exercise with the device a user moves or "drives" each handle around at least an arc which is part of a generally circular pathway around each pivot 14 & 14'. The user may move the handles together or separately. The user may move the handles clockwise or counterclockwise or one in each direction. The user can make slow movements or may use the device for a more aerobic workout by repeatedly circling the grips around the pivots on each side.

The user may grip the handles palm down or palm up. Those skilled in the art will recognize that grips shown as handles generally perpendicular to the rotatable wheel element 12 & 12', may be replaced with angled or movable grips.

The hand grips may be fixed to the rotatable wheel element 12 & 12' guides. It is preferred that the grips can freely rotate where attached to the rotatable wheel element 12 & 12'. The user's arm and hand movements, as shown in FIGS. 1D & 1E drive the wheel element 12' along the line of arrow 1000 around the spindle 14'. The spindle 14' acts as a pivot. Only one wheel element is shown in the side view of FIGS. 1D & 1E. This is not a limitation to the disclosure as the second wheel element is also being rotated as indicated by the movement of the back arm 104.

Figure 1B:
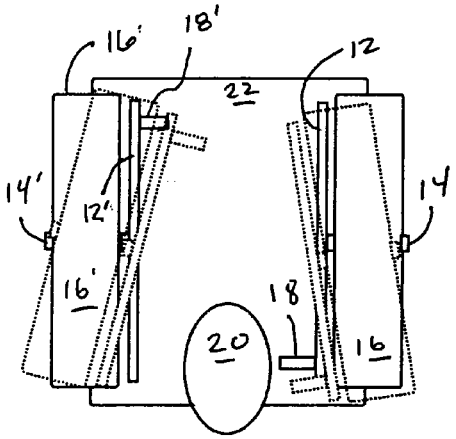
FIG. 1B is a top view of the dual circling exercise device of FIG. 1A.
Figure 1C:
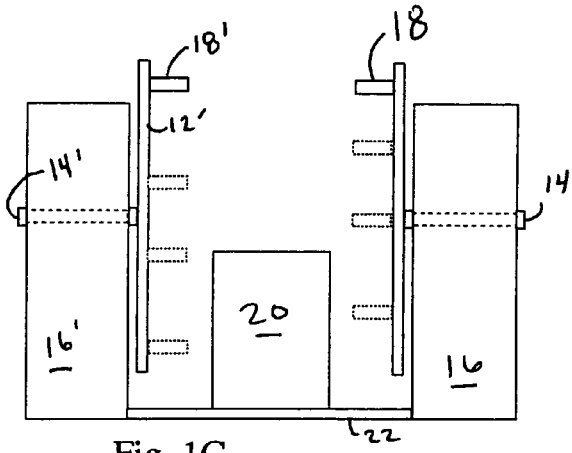
FIG. 1C is a front view of the dual circling exercise device of FIG. 1A.
Figure 1D:
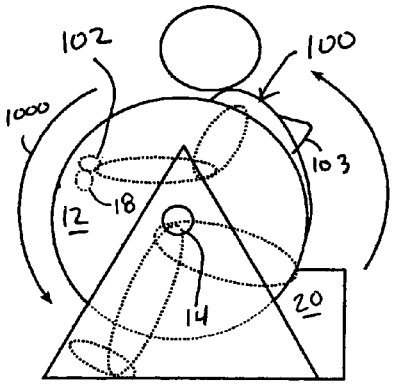
FIGS. 1D and 1E are side sequential views of the a method of use of the dual circling exercise device of FIG. 1A.
Figure 1E:
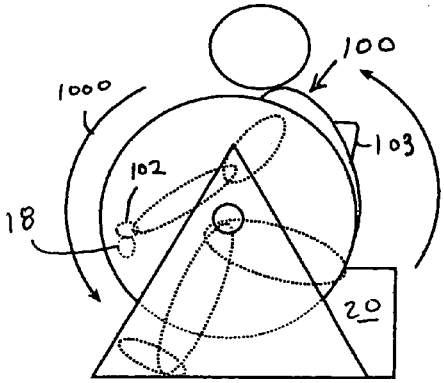
Figure 1F:
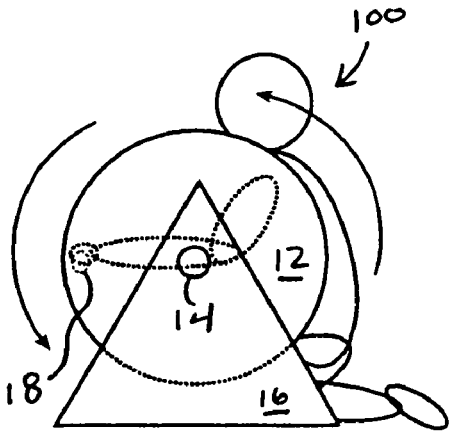
FIG. 1F is a side view of the kneel use of the dual circling exercise device of FIG. 1A.
Figure 1G:
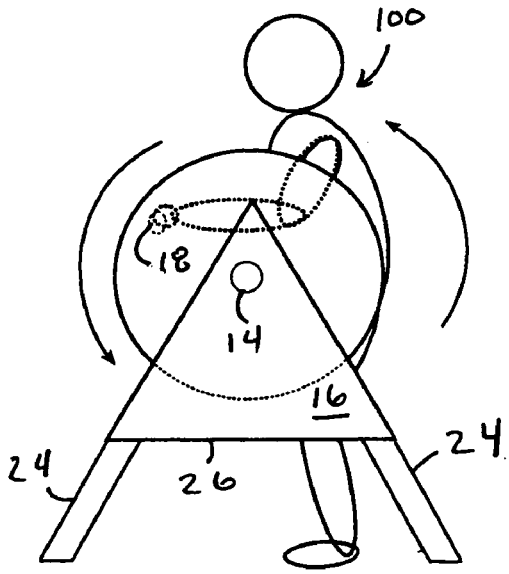
FIG. 1G is a side view of an alternate stand up dual circling exercise device of the dual circling exercise device.

The user 100 can sit on a seat 20 as shown in FIG. 1D and 1E, kneeling as shown in FIG. 1F, stand as shown in the embodiment of FIG. 1G or lie down as shown in FIG. 1H. The seat may be connected to, or rest on, a base 22. To raise the side base 16 leg lifts 24 are attached to the bottom 26 of the side base 16.

The side bases 16 & 16' may fix the rotatable wheel element 12 & 12' generally parallel to each other, or they may provide of adjustment of the rotatable wheel element 12 & 12' (as shown in FIG. 1B) whereby they are non-parallel thereby placing the hand grips 18 & 18' closer or further apart dependent on the angle of the wheels (or other moving member used instead of a wheel)

Figure 2:
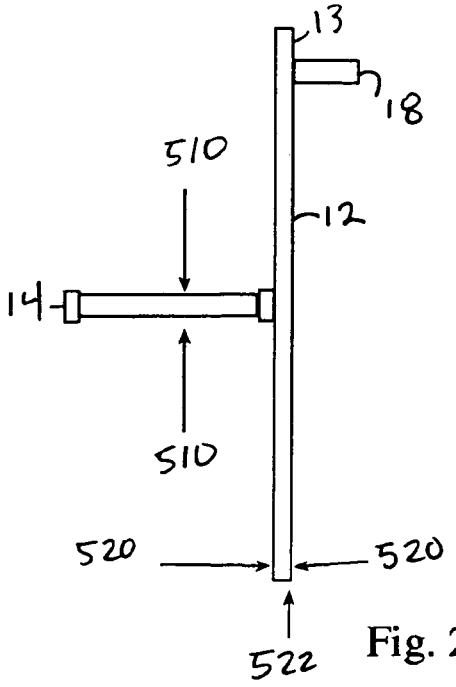
FIG. 2 is force application diagram of a circling wheel element.

Shown in FIG. 2 is a force diagram of a rotatable wheel element 12 showing regions where force may be applied. A braking or resistive force, frictional, frictionless may be applied to the spindle 14 along the lines, generally, of arrow 510. A braking or resistive force, frictional or frictionless may be applied to the edge 13 of the rotatable wheel element 12 along the line of arrows 520. A braking or resistive force, frictional or frictionless may be applied to the edge 13 of die rotatable wheel element 12 along the line of arrow 522. The rotatable wheel element 12 may also be weighted, separately or in addition to the application of a braking or resistive force. Those skilled in the art will recognize that the force diagram is applicable to other types of guides and the rotatable wheel elements are not a limitation.

Figure 3:
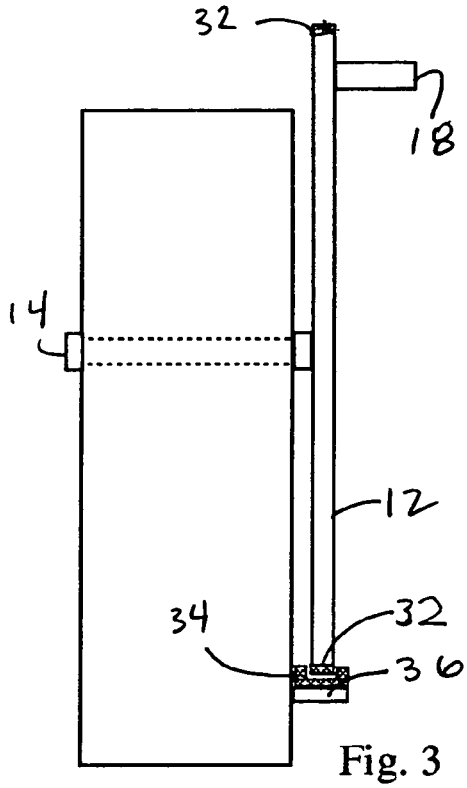
FIG. 3 is a partial view of a circling wheel element with magnetic resistance.

FIG. 3 shows the application of a magnetic force at the edge 13 of the rotatable wheel element 12. At the edge of the rotatable wheel element 12 a magnetic region 32 is provided. The magnetic region 32 may be magnetized metal or a material attractive to magnetic forces. A magnet 34 is connected to the device (at the side base) in either a fixed or adjustable fashion in close proximity to the magnetic region 32. In FIG. 3 the position of the magnet 34 is adjustable. Moving the magnet in relationship to the magnetic region 32 varies the magnetic force applied to the magnetic region 32. The magnet rests on a movable base 36. One or more magnets 34 may be placed around the rotatable wheel element 12. Magnetic force is without friction.

Figure 4:
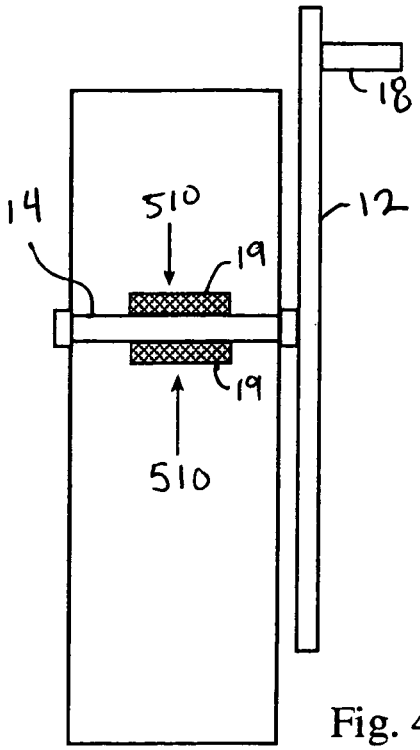
FIG. 4 is a partial view of a circling wheel element with friction resistance.

Shown in FIG. 4 is a friction brake 19 engaged at the spindle 14 whereby friction is applied to the spindle 14 along the line of arrow 510 to provide a resistive force. A friction brake may be mounted in any functional orientation. Spring mounts, elastic mounts, levers and clamping mounts are all within the scope of this invention.

Figure 5:
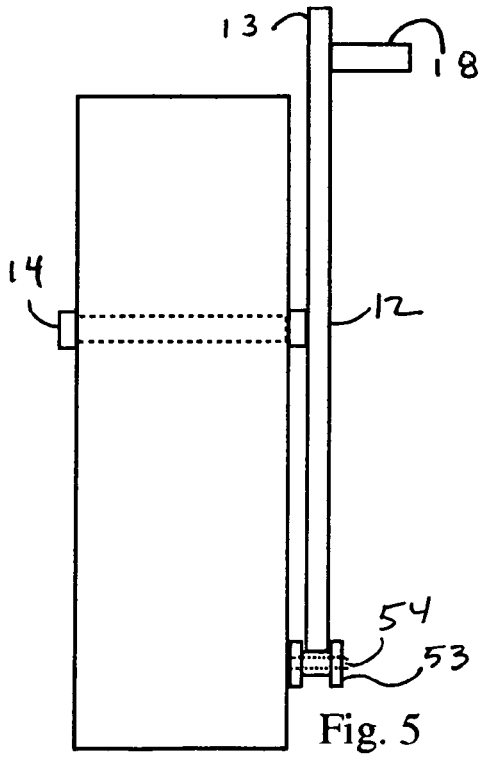
FIG. 5 is another partial view of a circling wheel element with friction resistance.

Shown in FIG. 5 is a friction roller 53 on a roller spindle 54 which is pressed against the edge 13 of the rotatable wheel element 12 to provide a resistive force. One or more rollers 53 may be placed around a rotatable wheel element 12.

Figure 6A:
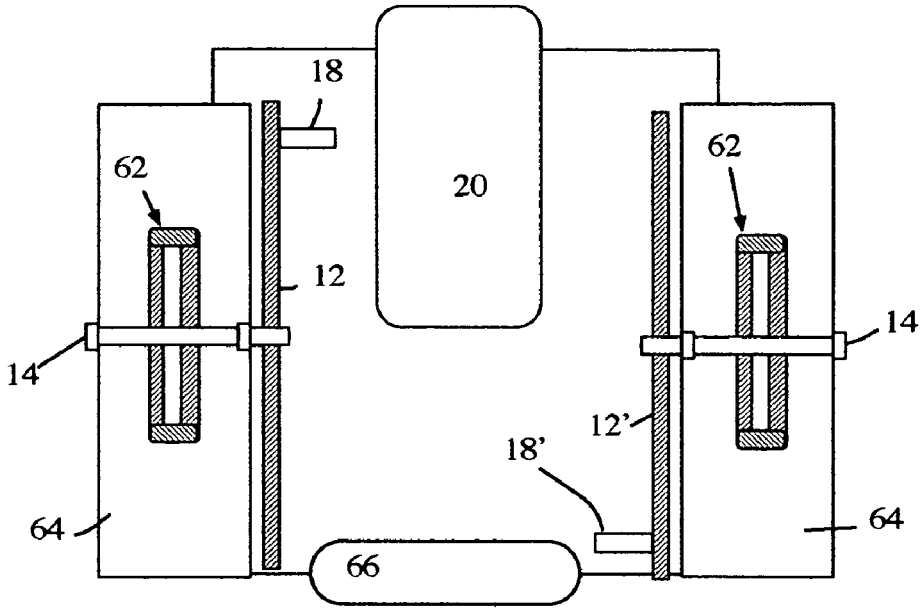
FIG. 6A is an another implementation of a dual circling exercise device of the exercise device.
Figure 6B:
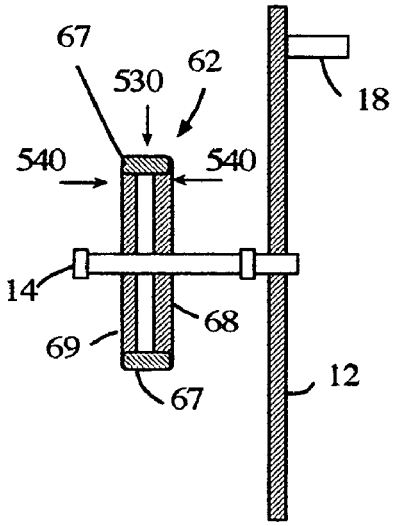
FIG. 6B is force application diagram of a circling wheel element with circling disk.

FIGS. 6A and 6B differs from FIG. 1A by the attachment of a rotating disk 62 & 62' affixed to each spindle 14 & 14' inside the interior of each side base 64 and 64'. A foot rest 66 is also provided. Rotating disks affixed to a spindle support act as part of the pivot around which a movable member can travel.

Shown in FIG. 6B is a magnetic or frictional force diagram of a rotating disk 62 and rotatable wheel element 12 showing regions where force may be applied to the rotating disk 62. A force Is shown applied to an edge 67 of the rotating disk 62 along the line of arrow 530. A magnetic or frictional force may be applied to the edge 67, the inner face 68 and/or the outer face 69 of the rotating disk 62 along the line of arrows 540. The rotating disk 62 may also be weighted.

Figure 7:
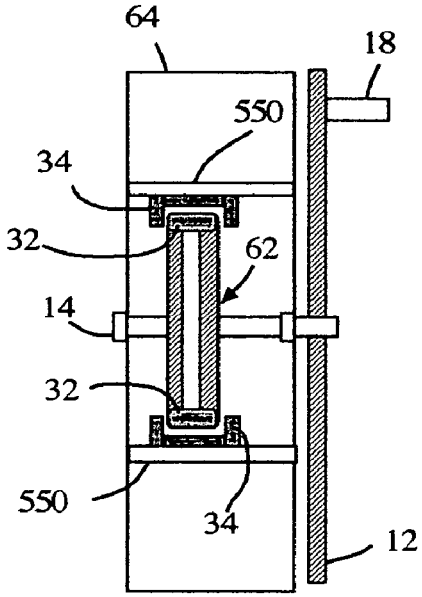
FIG. 7 is a partial view of a circling wheel element and circling disk with magnetic resistance.

Shown in FIG. 7 shows the application of a magnetic force at the edge 67, inner face 68 and outer face 69 of the rotating disk 62. At the edge of the rotating disk 62 a magnetic region 32 is provided. The magnetic region 32 maybe a magnetized metal or a material attractive to magnetic forces. A magnet 34 is affixed to the device (in the side base) in close proximity to the magnetic region 32. In FIG. 7 the magnets 34 are resting on a movable base 550. One or more magnets 34 maybe placed around the rotating disk 62 to form a magnetic region. The magnetic region may be larger or smaller than shown, and a portion of one or both of the inner face 68 and outer face 69 of the rotating disk 62 may be magnetized metal or formed of a material attractive to magnetic forces.

Figure 8A:
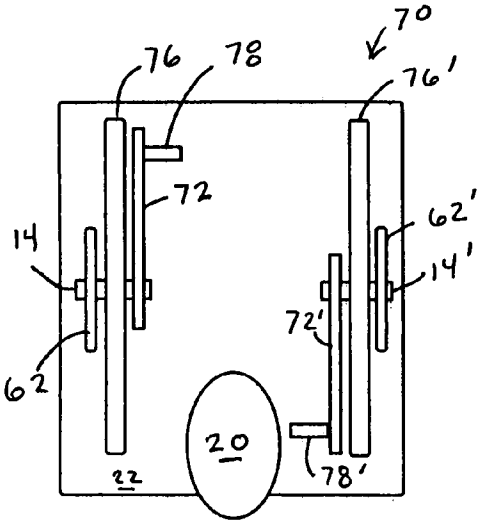
FIGS. 8A through 8C are another implementation of a dual circling exercise device of the exercise device.
Figure 8B:
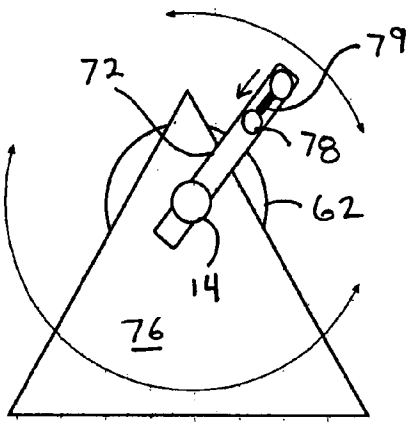
Figure 8C:
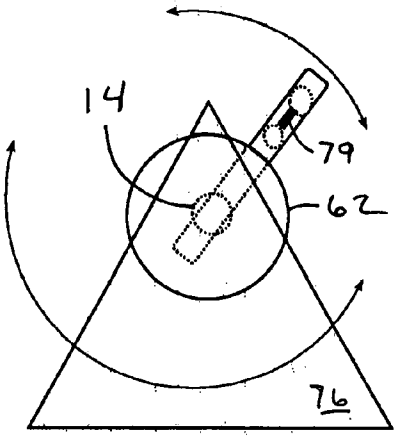

Shown in FIGS. 8A-8C is a dual rotating exercise device 70 wherein the guides are extended arms 72 & 72'. In this exemplary implementation the arms 72 & 72' are connected to rotating disks. A pair of rotating disks 62 & 62' are affixed, generally opposite one another, each to a spindle support 14 & 14', to a side base 76 & 76'. Each rotating disk 62 & 62' may also be weighted. A movable hand grip 78 & 78' is affixed movably to each arm 72 & 72'. A slot 79 in each arm 72 & 72' allows the hand grip 78 & 78' to slide in relation to the spindle 14 and 14'. The spindle is the pivot point. Altering the distance of a hand grip to a pivot point changes the distance the users hand, arm and body are guided through when rotating an arm around the spindle 14. The change in position of the hand grip also changes the force required to move the arm.

Figure 9:
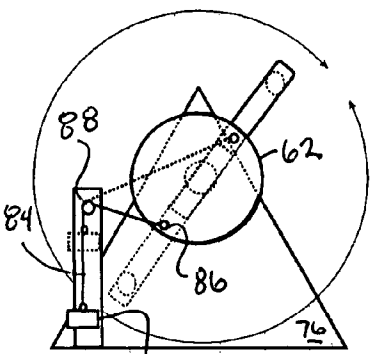
FIG. 9 is an alternate of the implementation of a dual circling exercise device shown in FIG. 8A with movable weight.

Shown in FIG. 9 is a side view of an exemplary implementation, with a lifting weight added. The embodiment shown in FIG. 9 operates similarly to the embodiments shown in FIGS. 8A-8C, however a weight 82, which may be a fixed amount or adjustable, is attached to the rotating disk 62. The weight 82 is held on a cable 84 which attaches to a cable mount 86 on the rotating disk 62. The cable is suspended from a cable guide 88. The weight travels up and down below the guide 88 corresponding to the movement of the rotating disk 62.

Figure 10A:
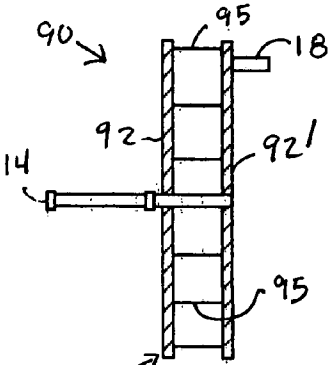
FIGS. 10A and 10B are partial views of a circling wheel element with air pressure resistance.
Figure 10B:
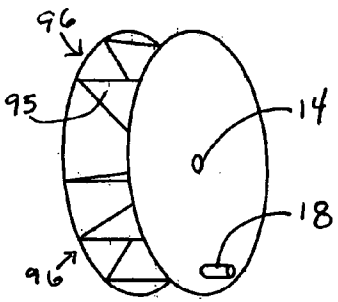

Shown in FIGS. 10A and 10B is a rotatable fan wheel element 90. Each fan wheel element 90 is constructed of two side wheels 92 & 92'. Spaced between the side wheels 92 & 92' are fan blades 95 which extend from the pivot 14 to the periphery 96 of the fan wheel element. The movement of the fan blades 95 through the air creates resistance against the fan blades 95 as the fan wheel element 90 is turned about the pivot 14 by the user moving the band grip 18.

Figure 11B:
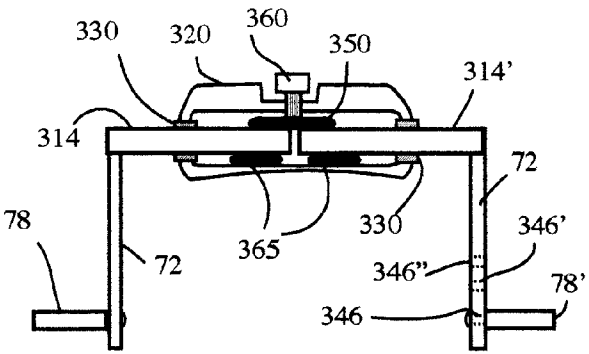
FIGS. 11A and 11B show another implementation of a dual circling exercise device.
Figure 11A:
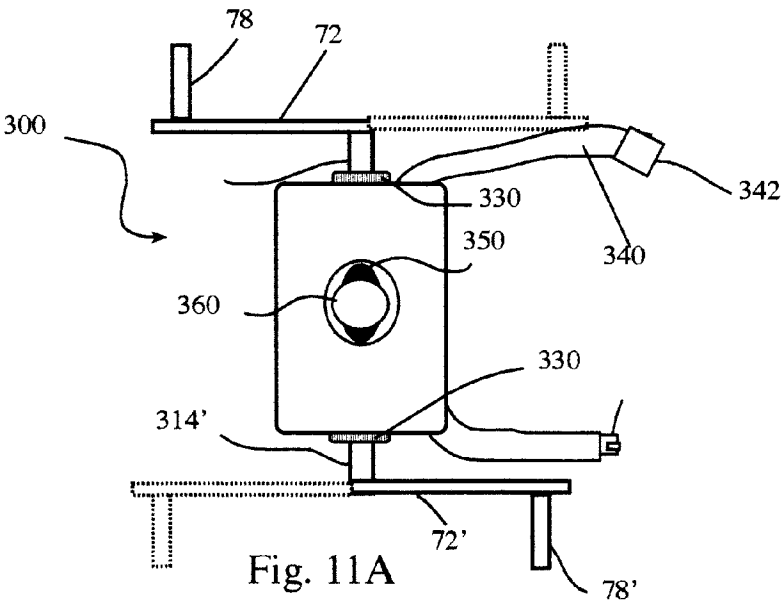
Figure 12:
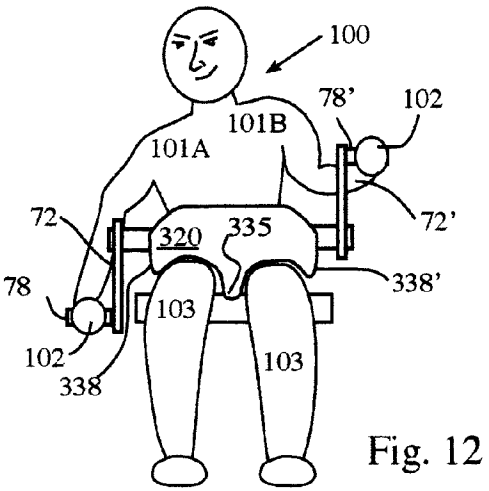
FIG. 12 shows another implementation of a dual circling exercise device.

Shown in FIGS. 11A and 11B is a dual rotating exercise device 300 which is supported, at least in part on a user's legs and/or lap as shown in FIG. 12. The guides for the dual rotating exercise device 300 are extended arms 72 & 72'. In this exemplary implementation the movable members include the extended arms connected to elongated spindle supports 314 & 314'. The movable member forms a guide around which the hand grips 78 & 78' move. The arms 72 & 72' connected to the elongated spindle support 314 & 314' are each movably fixed to a central base 320 whereby the arms may be moved, by the user 100, independently of each other. A user 100 will alternatively move the shoulders 101A & 101B forward as the user's hands 102 move with the movable members. Alternatively the elongated spindles may be connected and the extended arms 72 & 72' would thereby move non-independently.

The central base 320 is connected to a lap base whereby the central base 320 rests upon the legs 103 of the seated 500 user 100 during use.

The central base 320 may be constructed of a hard or soft material. The central base may be blow molded to accept water, sand, or other filler material to add weight. The central base may be a combination of soft and hard portions whereby the bottom portion, which rests on the user's legs and lap, may be harder or softer and the top portion the opposite in hardness or softness. The bottom portion of the central base 320 may be flat, contoured to fit the user's legs or a combination of curved and/or flat areas.

A pivot mount 330 is provided on each side of the central base 320. The pivot mount may be one or more bearings, sleeves or other structure which secures the elongated spindle supports 314 & 314' in a movable fashion to the central base 320.

The pivot mount 330 may also provide resistance. The resistance may be in the form of pressure on the pivot (spindle supports 314 & 314' in this implementation) by utilizing the pivot mounts 330 as a brake and a support for the pivot. To apply some resistance to the pivot, the pivot mount 330 may be constructed to tightly hold the pivot, or of multiple or overlapping parts which can be selectively tightened against the pivot Constructing the pivot mount from a low lubricity material or a high coefficient of fiction material whereby the ease which a user moves the pivot within the pivot mounts 330 is reduced may also be used to control resistance. One or more pivot mount may be the sole resistance providing element or it may be used in conjunction with other friction providing elements such as gears, belts, wheels, clutches, brakes and weight Shown in FIG. 12 is a keel 335 added to help limit movement of the central base during usage. In addition to, or in conjunction with, the keel 335 side legs 338 & 338' and/or a lap belt 340 (see FIG. 11A) with a fasteners 342 & 344 may also be added.

A hand grip 78 & 78' is affixed movably to each arm 72 & 72'. A slot may be provided in each arm 72 & 72'(shown in FIGS. 8A-C) to allow the hand grip 78 & 78' to slide. Alternatively hand grip mounts 346 -346"(shown in FIG. 1B) may be provided in which the hand grips maybe selectively mounted and unmounted. The elongated spindles supports each are a pivot point. Altering the distance of a hand grip to a pivot point changes the distance the user's 100 hand 102, arm and body are guided through when rotating an arm round the spindle supports 314 & 314' which act as the pivots. The change in position of the band grip also changes the force required to move the arm.

Resistance may be increased magnetically, as previously described, or by friction. Brakes, clutches belts and the like are suitable for providing frictional resistance. In this exemplary implementation a friction brake 350 at the spindle supports (pivots) 314 & 314' whereby friction is applied to the spindles supports 314 & 314' to provide a resistive force. Increasing the pressure of the friction brake 350 provides a greater force to rotate the spindle supports 314 & 314' against. A turn knob 360 supported by the central base 320 is shown in FIG. 11B. The turn knob 360 presses the friction brake 350 against the spindles 314 & 314'. Bottom brakes 365 may be added against which the pressure of the friction brake may work.

One of many possible alternative friction brakes are bicycle type cable pull brakes which apply pressure on either side of the pivot. Various other known friction brakes and members may be used and those skilled in the art will understand that the use of other friction producing brakes or members is within the scope of the invention herein. Separate frictional resistance members may be used to independently apply friction to each spindle support.

Figure 13:
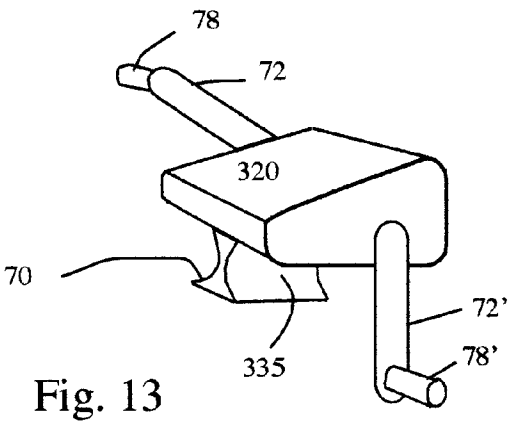
FIG. 13 shows another implementation of a dual circling exercise device.

Shown in FIGS. 13 are variations of the dual circling exercise device with keel 335 extensions. A contoured keel 335 to fit snuggly against the user's legs 103 is shown. A keel extension 375 may be added to further contour the around the user's legs thereby providing a region to squeeze and/or hold with a user's legs. The squeezing and/or holding may also be used to exercise the user's legs.

An implementation of a lap supported exercise device using friction brakes to apply resistance is shown in FIGS. 14A-14D. A brake 372 can be affixed to a flat spring member 374 and pressed against the pivot, in this implementation the rotating disk 62 is part of the pivot and the brake 372 is pressed against an edge of the rotating disk 62 mounted to a spindle support 314 in a pivot mount 330. The rotating disk may also be weighted. A weighted rotating disk without a frictional brake may be preferable in some implementations. The flat spring member 374 is not a limitation and torsion springs, coil springs or other types of spring members which are mounted to urge a friction brake against the rotating disk (pivot) may be used.

Figure 14A:
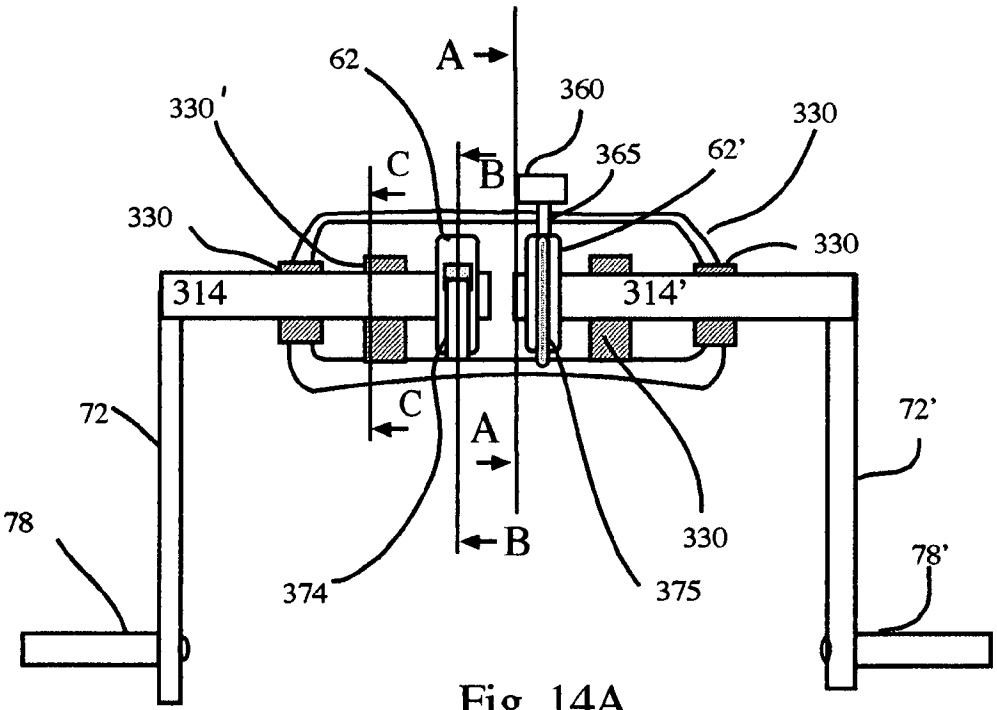
FIG. 14A shows a cut away of another implementation of a dual circling exercise device.
Figure 14B:
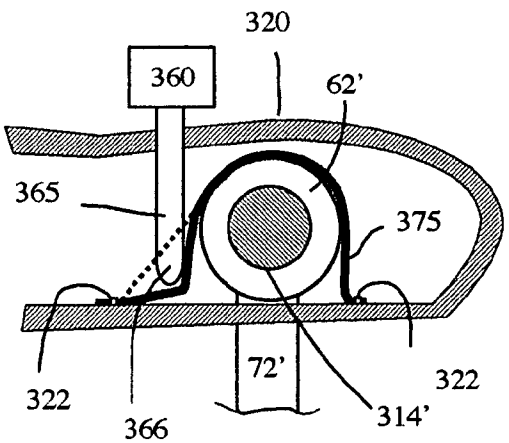
FIG. 14B shows a cut away view along line A-A of implementation shown in FIG. 14A.

A belt member 375 placed, under tension, against a pivot will also provide frictional resistance. In this implementation the rotating disk 62' is part of the pivot and the belt member 375 is against an edge of the rotating disk 62' which is mounted to a spindle support 314' in a pivot mount 330. The rotating disk may also be weighted. The belt member 375 may be set at a fixed tension or the tension may be adjustable. A turn knob 360 threaded through the central base 320 and with a pressure pin 365 is shown in FIG. 14B . The belt member 375 is attached to the inside of the central base 320 via fasteners 322 such as rivets, screws, hooks, bolts and adhesives. By moving the end 366 of the pressure pin 365 against the belt member 375 and the belt member is displaced thereby increasing the tension on the spindle support 314'.

Figure 14D:
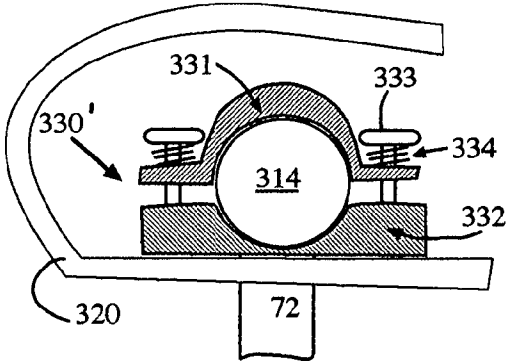
FIG. 14D shows a cut away view along line C-C of implementation shown in FIG. 14A.
Figure 14C:
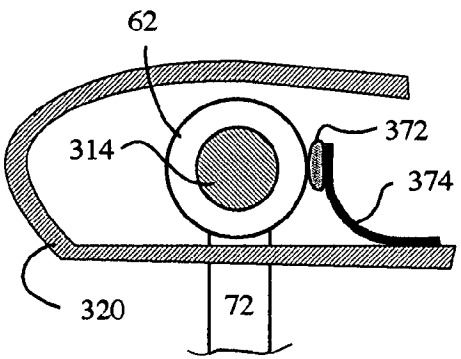
FIG. 14C shows a cut away view along line B-B of implementation shown in FIG. 14A.

The pivot mount 330' shown in FIG. 14D both supports pivot (spindle support 314) and applies resistance to the movement of the pivot via friction. A top section 331 of the pivot mount 330' is movable affixed to a bottom section 332. A fastener 333 and spring 334 are used to urge the top section 331 against the pivot (spindle support 314).

Figure 15A:
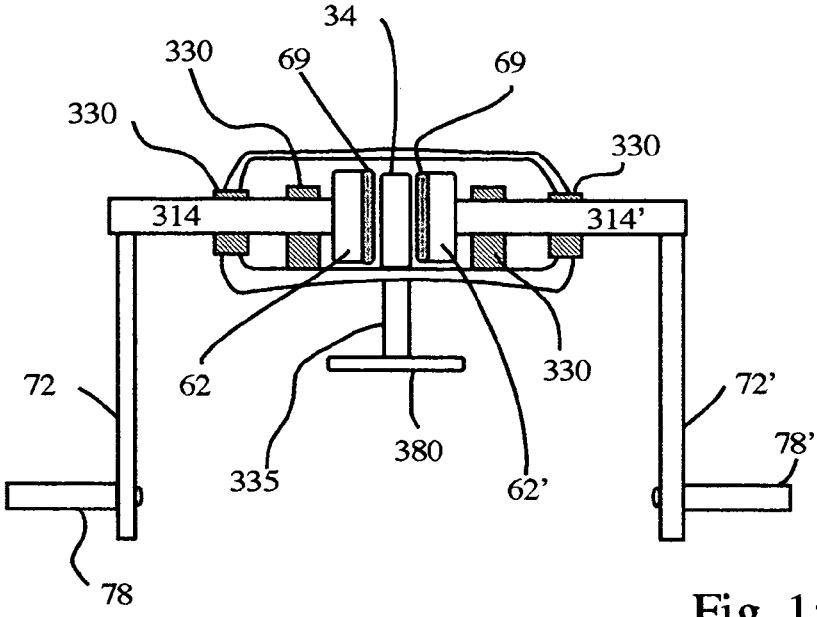
FIGS. 15A and 15B show another implementation of a dual circling exercise device.
Figure 15B:
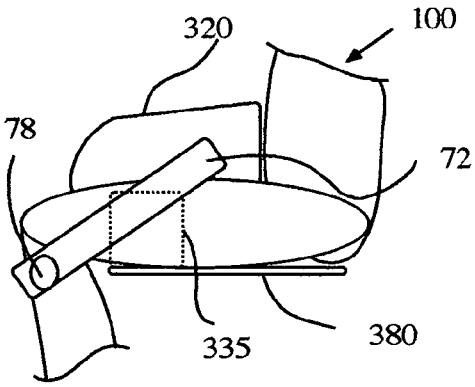

Shown in FIGS. 15A and 15B is a dual circling exercise device with a flat seat 380. The flat seat 380 is shown extended from the keel 335. A user places the central base 320 above the legs 103 and the fiat seat 380 below to hold the device in place during use. The flat seat may have extended legs (not shown) and form a stool The flat seat may be placed between a stool or chair 500 and the user. Inside the central base 320 are spindle supports 314 & 314' in pivot supports 330 connected to extended arms 72 and band grips 78. At one end of each spindle support 314 & 314' a rotating disk 62 & 62' is attached. In this implementation the outer face 69 of each rotating disk 62 & 62' is magnetized metal or a material attractive to magnetic forces. Between the two outer faces 69 are one or more magnets 34. The rotating disks 62 & 62' are separated from the magnet(s) 34 by an air gap. Spacers between the rotating disk 62 and magnet 34 may be used in place of an air gap. A spacer is preferably formed of a low friction material.

Figure 16:
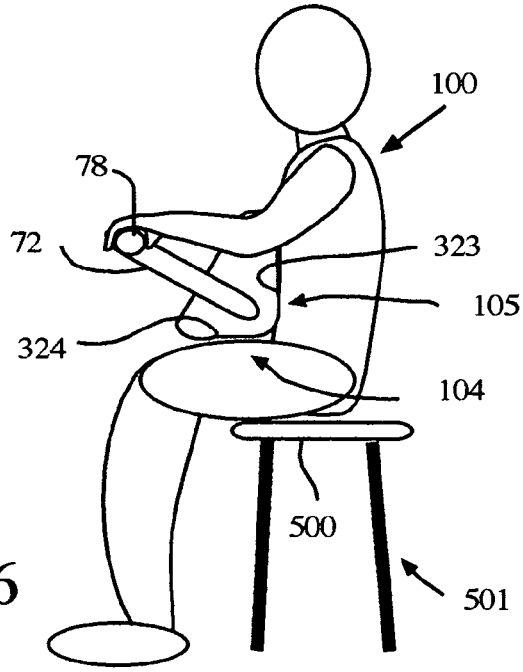
FIG. 16 shows another implementation of a dual circling exercise device.

In FIG. 16 an abdominal and lap positioned dual circling exercise device is shown. A first outer wall 323 of the central base 320 rests against the user's abdominal region 104. A second outer wall 324 of the central base 320 is on the user's lap (on top of the legs 103). The user 100 on a stool 501 with a seat 500 is shown using the device. Any tendency of the central base 320 to rotate during use may be reduced by placing the central base 320 against both the lap and abdominal regions of the user.

Figure 17A:
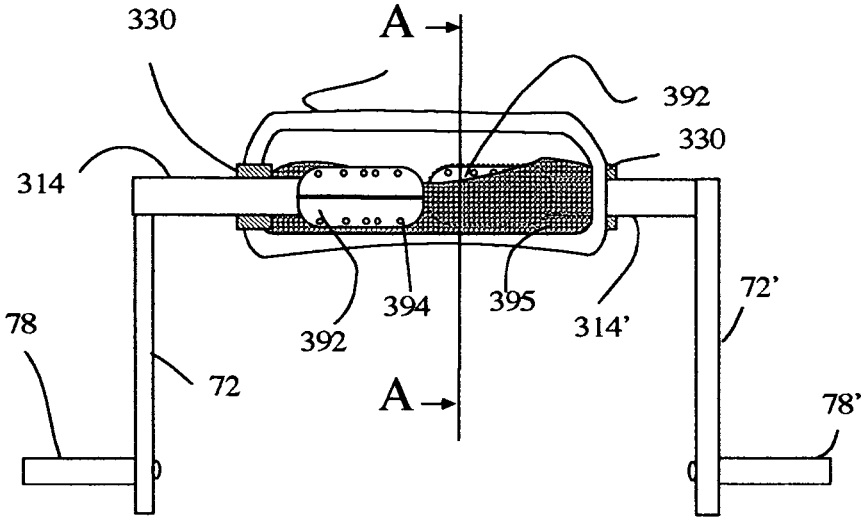
FIGS. 17A and 17B show another implementation of a dual circling exercise device.
Figure 17B:
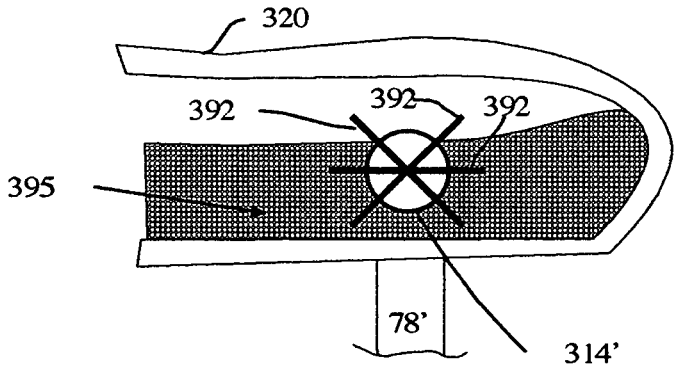

Another resistance means for a dual circling exercise device is shown in FIGS. 17A and 17B. Paddle members 392 are affixed to the ends of the spindles supports 314 & 314' which are inside the central base 320. Paddle blades secured around the spindle support form the paddle members 392. Channels 394 or other contours may be formed in the paddle members 392. A weighted substrate such as water, liquid, sand, gravel or beads are placed inside the central base 320. A blow molded central base 320 is a preferred process to form a central base 320 with a cavity. Appropriate gaskets, seals or bushings should be used to seal the cavity, particularly if water or other liquid is used as the substrate 395.

It is the movement of the paddle members 392 against the substrate 395 that provides the resistance to the user's rotation of the spindle supports 314 & 314'.

Figure 18:
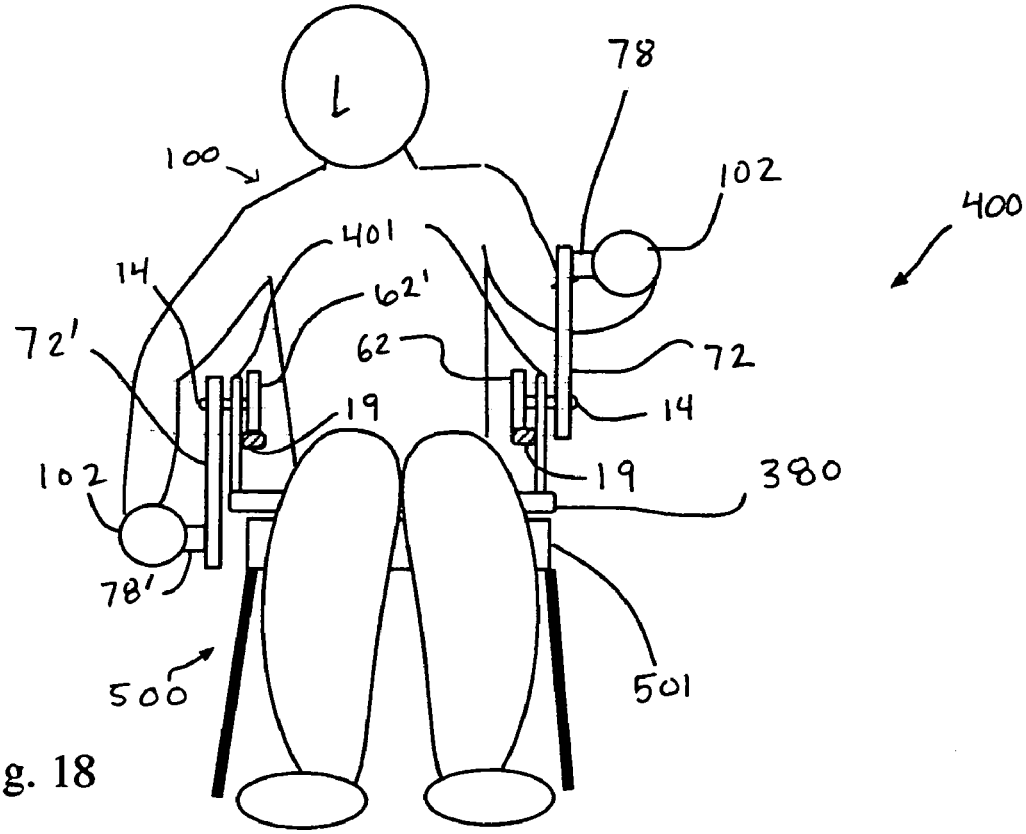
FIG. 18 show another implementation of a dual circling exercise device.

In FIG. 18 an under the user dual circling exercise device 400 is shown. The short wall supports 401 & 401' to which spindle supports 14 & 14' (the pivots) are affixed through function to support bat the extended inns 72 & 72' and the rotating disks 62 & 62'. A hand grip 78 & 78' is affixed movably to each arm 72 & 72'. The user's 100 hands 102 hold the hand grips 78. The user 100 places the flat seat 380 which supports the short wall supports 401 & 401' on a stool 501 wit a seat 500 (or other chair-like structure or bench). The user's body weight holds the device 400 against the seat 500. A friction brake 19 is shown. The brake provides a resistance against which the rotating disks must move during use. As previously discussed a wide variety of weighted, friction and/or non-friction resistance providing systems or devices maybe used in place of the friction brake 19.

Figure 19:
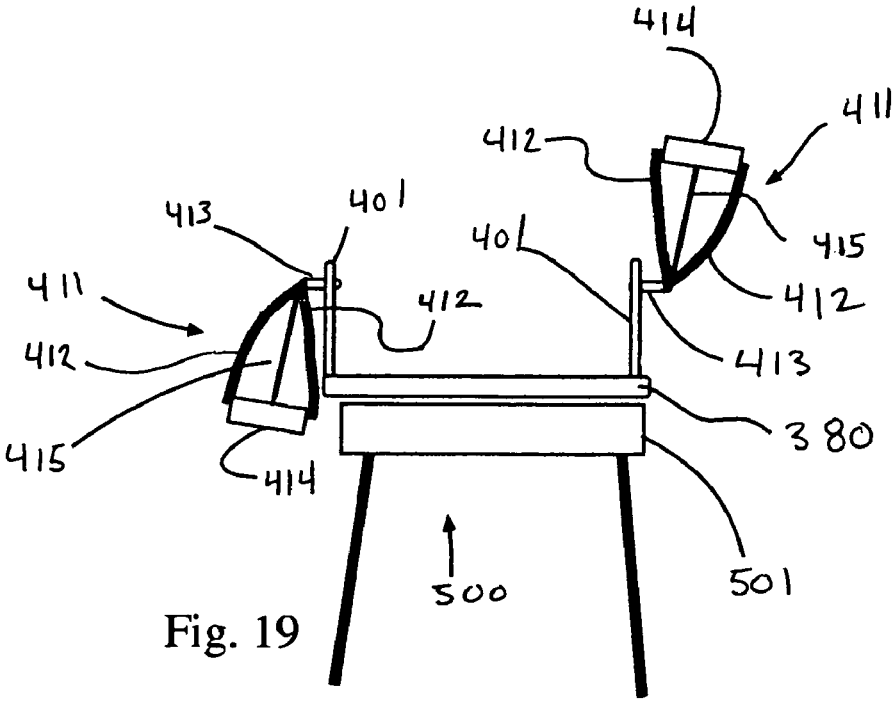
FIG. 19 show another implementation of a dual circling exercise device.

In FIG. 19 an under the user dual circling exercise device 410 is shown. Elastic arms 411 formed of elastic stands or cords 412 each connected to a short wall 401 at the pivot end 413 and to a hand grip 414 at the other end. A less elastic cord 415 (which may be a strap, rope or line) is also connected to the short wall 401 at the pivot end 413 and to the hand grip 414. The less elastic cord 415 can provide a limit to the elastic strand or cords 412 thereby limiting the distance the elastic arms 411 stretch. The short walls 401 are connected to a flat seat 380. During use a user sits on a stool 501 with a seat 500 (or other chair-like structure or bench). The user's body weight holds the device 410 against the seat 500. The user can drive the hand grips 414 around the pivot end 413 in a generally circular movement.

Since certain changes may be made in the above apparatus without departing from the scope of the invention herein involved, it is intended that all matter contained in the above description, as shown in the accompanying drawing, shall be interpreted in an illustrative, and not a limiting sense.

I claim:

1. A method of exercise comprising:

placing a base on a user's lap and held on top of and in between the user's legs with two generally opposing independently movable grips, each grip connected to a separate, independently movable guide, each guide being separately pivotally connected to the base via separate co-linearly aligned spindles within a housing having a frictional device within the housing radially compressing against a portion of each of the spindles to independently inhibit free rotation of each of the spindles;

adjusting a device extending into the housing which engages the frictional device in the housing to adjustably and radially compress the frictional device against each spindle, thereby inhibiting rotation of each of the spindles;

grasping a grip in each hand; and rotating each grip and its associated guide at least partially around each pivot.

2. The method of claim 1 wherein the guides are arms.

3. The method of claim 1 wherein the pivots are spindle supports.

4. The method of claim 1 wherein each pivot is a spindle support connected to a rotating disk.

5. The method of claim 4 further comprising applying a resistive force to at least one of the rotating disk and spindle support.

6. The method of claim 5 wherein the resistive force is frictional resistance.

7. The method of claim 5 wherein the resistive force is magnetic resistance.

8. The method of claim 3 wherein the spindles supports are movably connected to the base through pivot mounts.

9. The method of claim 8 wherein the pivot mounts provide resistance to the rotational movement of the spindle supports.

10. A method of exercising comprising:

providing a base having a pair of independently movable grips, each grip connected to a separate, independently movable guide, wherein each guide is connected via a separate independent pivot to the base via separate co-linearly aligned spindles within a housing on the base having a frictional device within the housing radially compressing against a portion of each of the spindles to independently restrain free rotation of each of the spindles;

adjusting a device extending into the housing which engages the frictional device in the housing to adjustably and radially compress the frictional device against each spindle, thereby restraining rotation of each of the spindles;

placing the base on a user's lap and held on top of and between the user's legs;

grasping each of the grips;

rotating each of the grips at least partially about each of the pivots using the user's arms.

11. The method of claim 10 wherein each pivot is a spindle support connected to a rotating element.

12. The method of claim 11 further comprising applying a resistive force to at least one of the rotating element and spindle support.

13. The method of claim 12 wherein the resistive force is frictional resistance.

14. The method of claim 12 wherein the resistive force is magnetic resistance.

* * * * *